United States Patent [19]

Nestenius

[11] 4,426,942

[45] Jan. 24, 1984

[54] EYE SHANK BUTTON ATTACHING APPARATUS

[75] Inventor: Nils O. Nestenius, Helsingborg, Sweden

[73] Assignee: Styrteknik Olof Nestenius AB, Sweden

[21] Appl. No.: 229,601

[22] PCT Filed: May 17, 1980

[86] PCT No.: PCT/EP80/00027

§ 371 Date: Jan. 16, 1981

§ 102(e) Date: Jan. 16, 1981

[87] PCT Pub. No.: WO80/02550

PCT Pub. Date: Nov. 27, 1980

[30] Foreign Application Priority Data

May 18, 1979 [GB] United Kingdom ..... 7917376

[51] Int. Cl.[3] ..... B68G 7/08; D05B 3/16

[52] U.S. Cl. ..... 112/108

[58] Field of Search ..... 112/108, 3 R

[56] References Cited

U.S. PATENT DOCUMENTS

| | | | |
|---|---|---|---|
| 392,096 | 10/1888 | Bennett . | |
| 1,399,527 | 12/1921 | Smith . | |
| 1,415,250 | 5/1922 | LeVeque . | |
| 2,048,348 | 2/1934 | Mathewson | 112/3 R |
| 2,811,939 | 11/1957 | Minel | 112/108 |
| 3,008,607 | 11/1961 | Troll | 112/108 X |

FOREIGN PATENT DOCUMENTS

| | | |
|---|---|---|
| 64724 | 12/1891 | Fed. Rep. of Germany . |
| 318920 | 5/1916 | Fed. Rep. of Germany . |
| 1536052 | 12/1978 | United Kingdom . |

*Primary Examiner*—Werner H. Schroeder
*Assistant Examiner*—Andrew M. Falik
*Attorney, Agent, or Firm*—Charles W. Helzer

[57] ABSTRACT

Apparatus for looping tying material about the eye of a button comprising a device for supporting a button having an eye or eye shank extending outwardly from a reverse side thereof and a device for passing a doubled length of tying material through the eye of a button together with apparatus for looping one of the two strands of the doubled length of tying material about the eye or eye shank of the button. The looping apparatus comprises a shoulder formed on a rotatable semi-conical member for engaging one strand of the doubled length of tying material beyond where the tying material passes through the eye of the button. The semi-conical member is rotatable about an axis which is inclined relative to the axis of the button while the apparatus is in use. The looping apparatus is designed such that the one strand will be carried by the shoulder around the eye or eye shank of the button first in a direction away from the button so that a loop is formed in the strand around the semi-conical member to maintain the strand in engagement with the shoulder, then in a direction towards the button to disengage the loop from the semi-conical member and finally again in a direction away from the button to disengage the strand from the shoulder.

11 Claims, 10 Drawing Figures

Fig. 1
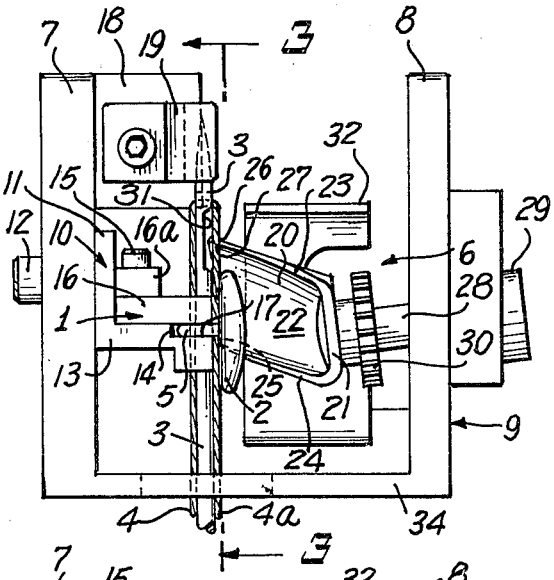
Fig. 3
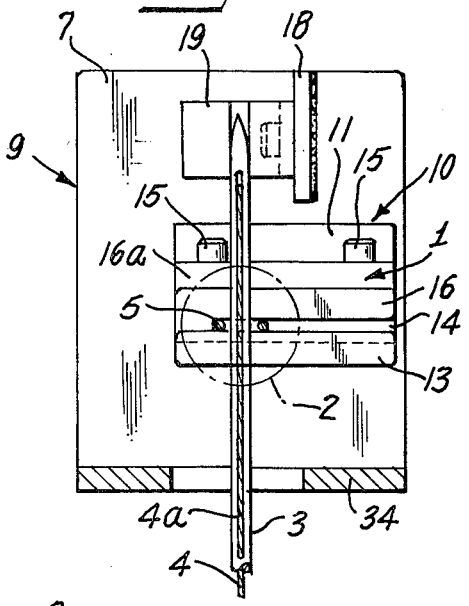
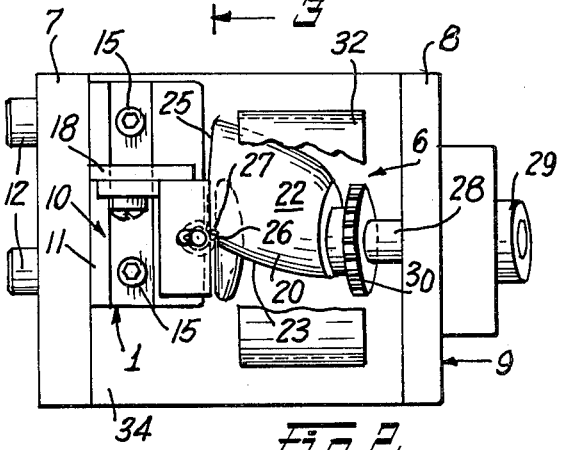
Fig. 2
Fig. 5
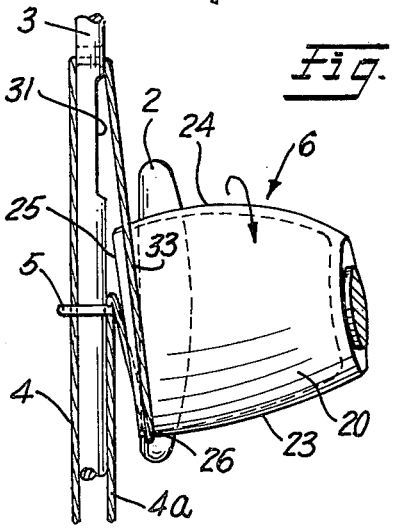
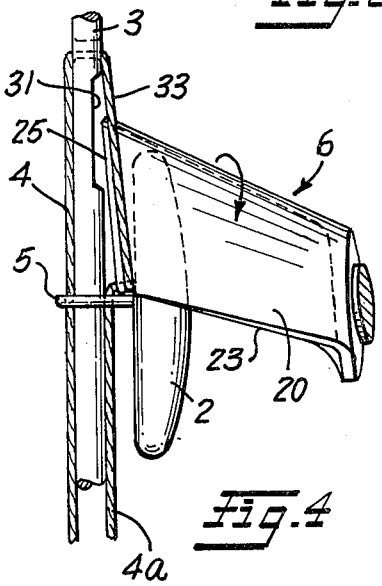
Fig. 4
Fig. 6
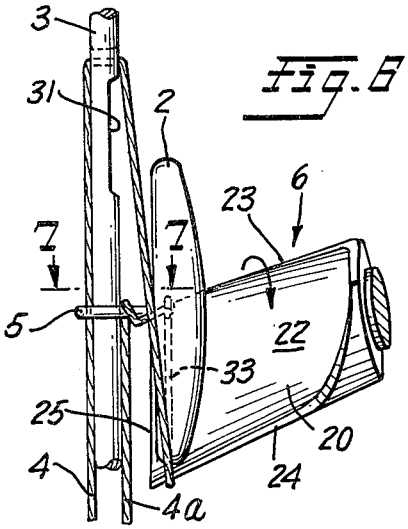

EYE SHANK BUTTON ATTACHING APPARATUS

The present invention relates to apparatus for looping tying material about the eye or eye shank of a button.

Padded articles such as mattresses or cushions are often indented by means of two buttons, each having an eye or eye shank, being linked on either side of the padded article. The buttons are connected by tying material, such as thread, twine, or the like which passes through the eye of a first button, through the padded article and through the eye of a second button. The tying material is looped around the eye of the second button thereby securing the button, the needle is withdrawn and then the tying material knotted about the first button. The depth of the indentation is determined by the length of the tying material linking the two buttons.

Apparatus for securing buttons in padded articles in such a manner is described in United Kingdoms Pat. No. 1536052 published Dec. 20, 1978 and assigned to Styrtenik Olof Nestenius, A. B., of Helsingborg, Sweden. The apparatus therein described uses a rotary hook, similar to that used on a sewing machine, for looping tying material around the eye of a second button. Such a hook suffers, however, from the disadvantage that the tying material is not automatically released from the hook after looping has occurred with the result that the operation of the apparatus is delayed while the tying material is disconnected from the hook.

The present invention has as its object to provide improved apparatus for looping tying material around the eye of a button which overcomes the aforesaid disadvantage.

The present invention provides apparatus for looping tying material about the eye of a button comprising:

means for supporting a button having an eye or eye shank extending outwardly from a reverse side thereof, means for passing a doubled length of tying material through the eye of a button supported by the supporting means, and means for looping one of the two strands of a said doubled length of tying material about the eye or eye shank of a said button, the looping means comprising a shoulder for engaging a said one strand of a doubled length of tying material beyond where the tying material passes through the eye of the button, the looping means being rotatable about an axis which is inclined relative to the axis of a button supported by said supporting means when the apparatus is in use whereby said one strand will be carried by said shoulder around the eye or eye shank of the button first in a direction away from the button so that a loop is formed in said strand around the looping means to maintain the strand in engagement with said shoulder, then in a direction towards the button to disengage the loop from the looping means and finally again in a direction away from the button to disengage the strand from said shoulder.

Said shoulder may be provided on a semi-conical member which partially surrounds a button supported by the button supporting means when the apparatus is in use. Said semi-conical arcuate member may comprise a base portion mounted on one end of a shaft which is rotatable to rotate the looping means and an arcuate wall which extends both axially and radially outwards from said base portion, the arcuate wall having a leading edge, a trailing edge and an arcuate outer edge remote from the base portion and extending between the leading and trailing edges. A cut-out is provided at the junction of the leading edge with the arcuate outer edge to form said shoulder. Both the leading edge and the trailing edge are inclined relative to a plane in which the axis of rotation of the looping means lies, the leading edge being inclined from the base portion away from the direction of rotation of the looping means and the trailing edge being inclined from the base portion toward the direction of rotation of the looping means. With such an arrangement a said strand of tying material will be directed toward and into engagement with the shoulder by the leading edge should the strand initially engage the leading edge instead of the shoulder. As the looping means is rotated, a strand engaged by the shoulder will be carried around the eye or eye shank of a button and will at the same time form a loop about the arcuate wall. Because the rotational axis of the semi-conical arcuate member is inclined relative to the axis of the button on which the tying material is being looped, said arcuate wall moves first in a direction away from the button so that the loop formed around the arcuate wall maintains the said strand in engagement with the shoulder. Next the arcuate wall moves in a direction towards the button so that the loop which has formed around the arcuate wall is caused by the inclined trailing edge to disengage from the arcuate wall. With continued rotation of the looping means the arcuate wall again moves in a direction away from the button to disengage the strand from said shoulder. In all the arcuate wall may rotate through approximately 470° from its initial starting position during each looping operation, the arcuate wall moving away from the button during approximately the first 180° of rotation, back towards the button during approximately the next 180° of rotation, and then again away from the button during approximately the last 110° of rotation.

The means for passing a doubled length of tying material through the eye of a button preferably comprises a needle which can be advanced to carry a doubled length of tying material through the eye of a button, maintained in the advanced position while one strand of the doubled length of tying material is looped around the eye or eye shank of the button, and then retracted to tighten the loop around the eye or eye shank of the button.

The apparatus of the present invention is intended for use in apparatus for securing buttons in padded articles as described and claimed in United Kingdom Pat. No. 1,536,052 to which reference is made and the description of which is incorporated herein by reference. The apparatus of the present invention is intended to replace the rotary hook which forms part of the apparatus described in United Kingdom Pat. No. 1,536,052. It will be understood, however, that the apparatus of the present invention is not limited to this intended use and may be used in any application where it is required to loop tying material around the eye or eye shank of a button.

The invention will be more particularly described with reference to the accompanying diagrammatic drawings, in which:

FIG. 1 is a side elevational view of apparatus according to the present invention for looping tying material about the eye or eye shank of a button;

FIG. 2 is a top plan view of the device of FIG. 1;

FIG. 3 is a vertical sectional view, taken on the lines 3-3 of FIG. 1;

FIGS. 4 to 9 are enlarged diagrammatic views illustrating how a loop is formed around the eye or eye shank of a button using the apparatus of the present invention.

Figure 7:
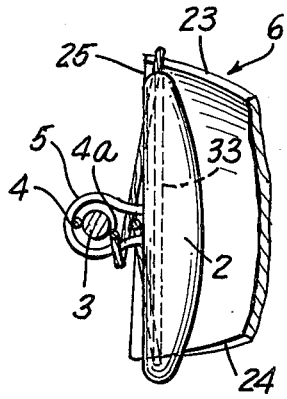

Referring to the drawings, and in particular to FIGS. 1-3, it will be seen that the apparatus comprises means 1 for supporting a button 2, a needle 3 for passing a doubled length of tying material 4 through the eye 5 of the button 2 and means 6 for looping one strand 4*a* of the doubled length of tying material 4 around the eye 5 of the button 2. The button supporting means 2 and the looping means 6 are mounted on opposed limbs 7 and 8 of a substantially U-shaped frame 9.

The button supporting means 1 is designed for supporting buttons 2 of the kind which can be covered with a suitable textile or other material, e.g., an upholstery material to match the upholstery of a cushion to be buttoned, and which has a metal backing plate from which projects a metal wire loop which forms the eye 5. The button supporting means 1 comprises a non-magnetic angle bracket 10 one arm 11 of which is secured to the limb 7 of the frame 9 by means of screws, bolts or the like 12 and the other arm 13 of which is stepped as shown at 14. Secured on the arm 13 by means of a screw, bolt or the like 15 is a magnetic block 16. A non-magnetic backing plate 16*a* is interposed between the magnetic block 16 and the head of the screw, bolt or the like 15. A slot 17 is defined between the stepped portion 14 of the arm 13 and the magnetic block 16 for the reception of the eye 5 of a button 2. That end of the slot 17 adjacent the needle 3 is closed to form a stop (not shown) for the eye 5 of a button 2. An aperture (not shown) is formed in the arm 13 and a magnetic block 16 through which the needle 3 can pass and the said stop for the eye 5 of a button 2 is so located that the eye 5 of a button 2 will be aligned with said aperture when the eye of the button is engaged in the slot 17 and the button slid along the slot until the eye 5 thereof engages said stop, thus ensuring that when the needle 3 is advanced and passes through said aperture it will also pass through the eye 5 of a button engaged in said slot 17. The magnetic attraction of the block 16 acting on the metal backing plate of the button 2 is sufficient to retain the button 2 in engagement with the slot 17 until such time as the needle 3 has been advanced and has passed through the eye 5 of the button. Thereafter, during the looping operation, the button 2 is retained in engagement with the slot 17 by the needle 3.

The limb 7 of the frame 9 has an inwardly extending flange 18 thereon on which is mounted a guide block 19 having a tapered bore extending therethrough for receiving and guiding the leading end of the needle 3.

The looping means 6 comprises a semi-conical arcuate member 20 which partially surrounds a button 2 supported by the button supporting means 1. The arcuate member 20 comprises a substantially planar base portion 21 and an arcuate wall 22 which extends both axially and radially outwards from the base portion 21, the arcuate wall 22 having a leading edge 23, a trailing edge 24 and a arcuate outer edge 25 remote from the base portion 21. Thus the semi-conical arcuate member 20 is substantially in the form of a segment of a hollow frustocone. A cut-out 26 is provided at the junction of the leading edge 23 and the arcuate outer edge 25 so as to form a shoulder 27 for engaging said one strand 4*a* of the doubled length of tying material 4. The base portion 21 is fixedly secured to one end of a shaft 28 which is mounted for rotation in a bearing 20 mounted in the limb 8 of the frame 9. The shaft 28 has a sprocket wheel 30 thereon which is engageable by a chain (not shown) actuatable by an air cylinder (not shown) for rotating the shaft 28 and the semi-conical arcuate member 20 mounted thereon. The axis of rotation of the shaft 28, and hence of the arcuate member 20, lies in a plane containing the axis of the needle 3 and is inclined with respect to the axis of a button 2 supported by the button supporting means 1. The leading edge 23 and the trailing edge 24 of the arcuate wall 22 are each inclined with respect to a plane containing the axis of shaft 28, the leading edge 23 being inclined from the base portion 21 away from the direction of rotation and the trailing edge 24 being inclined from the base portion 21 towards the direction of rotation. The junction of the trailing edge 24 with the arcuate outer edge 25 is radiussed. The needle 3 has a recess 31 therein adjacent the eye (not shown) thereof across which the said one strand 4*a* of the tying material 4 extends. The shoulder 27 of the arcuate member 20 passes through the recess 31 when the semi-conical arcuate member 20 is rotated and so engages said one strand 4*a*.

An arcuate shield member 32 is mounted on the limb 8 of the frame 9 and partially surrounds the looping means 6.

Figure 8:
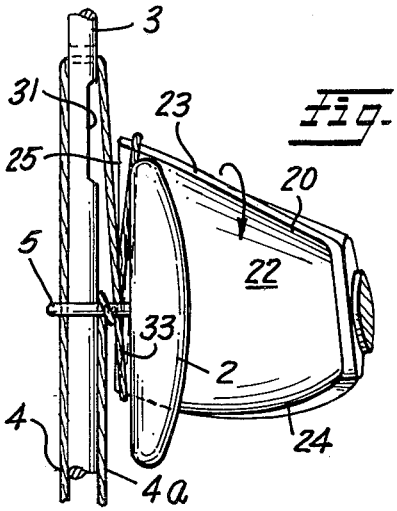
Figure 9:
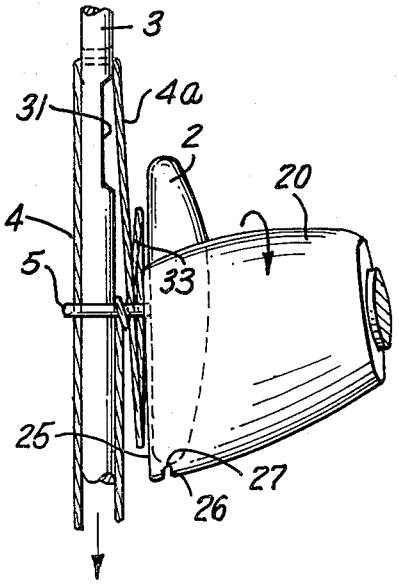

The operation of the apparatus will now be described with reference to FIGS. 4 to 9. A button 2 is engaged in the slot 17 of the button supporting means 1 and is slid along the slot 17 until the eye 5 thereof engages the said stop. The needle 3 is then advanced so as to pass through the eye 5 of the button 2. In so doing the needle carries through the eye 5 a doubled length of tying material 4. The semi-conical arcuate member 20 rotates in a counter-clockwise direction as viewed from the base end 21 and its initial starting position is as shown in FIG. 4 with the shoulder 27 just to the rearward of the recess 31 in the needle 3 in the direction of rotation. As the arcuate member 20 is rotated through approximately the first 90° to the position shown in FIG. 5 one strand 4*a* of the tying material 4 is engaged by the shoulder 27 and is carried partially around the eye 5 of the button. At the same time a loop 33 of the strand 4*a* begins to form around the semi-conical arcuate member 20. Because of the inclination of the rotational axis of the arcuate member 20 relative to the axis of the button 2 as hereinbefore described, the arcuate member 20 is gradually moving in a direction away from the button 2 and needle 3 during this initial movement with the result that the shoulder 27 is further from the needle 3 than the trailing end of the arcuate outer edge 25 and the said loop 33 tends to slide on the outer surface of the arcuate wall 22 in a direction away from the button 2 and needle 3 to maintain the strand 4*a* in engagement with the shoulder 27. After approximately 180° of rotation, during which the arcuate member 20 continues to move in a direction away from the button 2 and needle 3, the arcuate member 20 will be in the position shown in FIG. 6. As will be seen, the strand 4*a* is now almost completely looped around the eye 5 of the button 2 and the loop 33 is now formed almost completely around the arcuate member 20. Rotation through approximately a further 90°, i.e., through approximately 270° from its initial position, brings the arcuate member 20 to the position shown in FIG. 7. The strand 4*a* now completely encircles the eye 5 of the button 2 and the loop 33 now completely encircles the arcuate member 20. During this further 90° of rotation the arcuate member 20 has started to move in a direction back towards the button 2 and needle 3 with the result that the shoulder 27 is now nearer to the needle 3 than the trailing end of the arcuate outer edge 25. Continued rotation through a further approximately 90° brings the arcuate member 20 back to substantially its initial starting position as shown in FIG. 8. During this continued rotation the arcuate member 20 has continued to move in a direction back towards the button 2 and needle 3. The strand 4*a* is now looped approximately one-and-a-half times around the eye 5 of the button 2 and the trailing edge 24 of the arcuate member 20 has now reached a position wherein it is inclined in the direction of rotation so that the loop 33 begins to slide therealong towards the arcuate outer edge 25. A final approximately 90° of rotation, for a total rotational movement of the arcuate member 20 of approximately 470°, brings the arcuate member to the position shown in FIG. 9. The arcuate member 20 has started to move again in a direction away from the button 2 and the needle 3. During this final 90° of rotation the loop 33 slides completely off the trailing edge 24 of the arcuate member 20 and is directed by the arcuate outer edge 25 towards the needle 3 so as to disengage the loop 33 from the shoulder 27. Finally the needle 3 is retracted to tighten the loop in the strand 4*a* which is around the eye 5 of the button 2. During this tightening of the loop around the eye of the button the loop 33 is pulled out and ceases to be needed. The retraction of the needle 3 also serves to release the button 2 from the button holding means 1 and to pull the button through an aperture (not shown) in the portion 34 of frame 9 which connects the limbs 7 and 8, e.g., into engagement with a padded article which is being provided with buttons.

Figure 10:
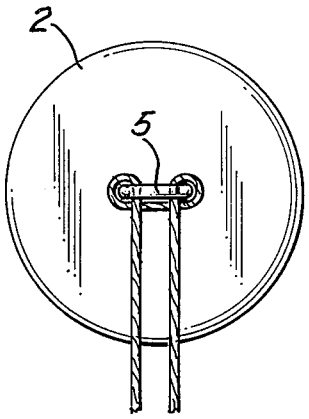
FIG. 10 is a rear elevational view of a button having tying material looped around the eye or eye shank thereof.

The loop formed around the eye 5 of the button 2 is shown in FIG. 10.

I claim:

1. Apparatus for looping tying material about the eye of a button comprising:

means for supporting a button having a front side and an eye or eye shank extending outwardly from a reverse side thereof, means for passing a doubled length of tying material through the eye of a button supported by the supporting means, and means for looping one of the two strands of a said doubled length of tying material about the eye or eye shank of a said button, the looping means comprising an arcuate member which partially surrounds a button supported by the button supporting means when the apparatus is in use and having a base portion mounted on one end of a shaft which is rotatable to rotate the looping means and an arcuate wall which extends both axially and radially outwards from said base portion, the arcuate wall having a leading edge, a trailing edge and an arcuate outer edge remote from the base portion and extending between the leading and trailing edges, a cut-out in said arcuate wall at the junction of the leading edge with the arcuate outer edge to form a shoulder, both the leading edge and the trailing edge being inclined relative to a plane in which the axis of rotation of the looping means lies, the leading edge being inclined from the base portion away from the direction of rotation of the looping means and the trailing edge being inclined from the base portion toward the direction of rotation of the looping means, said shoulder being adapted to engage a said one strand of a doubled length of trying material beyond where the tying material passes through the eye of the button, the looping means being rotatable about an axis which is inclined relative to the axis of a button supported by said supporting means when the apparatus is in use whereby said one strand will be carried by said shoulder around the eye or eye shank of the button first in a direction from the reverse side towards the front side of the button so that a loop is formed in said strand around the looping means to maintain the strand in engagement with said shoulder, then in a direction from the front side towards the reverse side of the button to disengage the loop from the looping means and finally again in a direction from the reverse side towards the front side of the button to disengage the strand from said shoulder.

2. Apparatus according to claim 1, wherein said arcuate wall is adapted to rotate through substantially 470° from its initial starting position during each looping operation.

3. Apparatus according to claim 2, wherein said arcuate wall, during each looping operation, moves in a direction from the reverse side towards the front side of the button during substantially the first 180° of rotation, back towards the front side of the button during substantially the next 180° of rotation and then again from the reverse side toward the front side of the button during substantially the last 110° of rotation.

4. Apparatus according to claim 1 wherein said means for passing a doubled length of tying material through the eye of a button comprises a needle.

5. Apparatus according to claim 4, wherein said needle can be advanced to carry a doubled length of tying material through the eye of a button supported by the button supporting means, maintained in the advanced position while one strand of the doubled length of tying material is looped around the eye or eye shank of the button, and then retracted to tighten the loop around the eye or eye shank of the button.

6. Apparatus according to claim 4, wherein said needle has a recess therein across which said one strand of tying material passes when the apparatus is in use and wherein said shoulder is arranged to pass through said recess to engage said one strand of tying material.

7. Apparatus according to claim 1, wheren said button supporting means comprises a slot adapted to receive the eye or eye shank of a button and means for retaining the button with its eye or eye shank in engagement with said slot.

8. Apparatus according to claim 7, wherein said means for passing a doubled length of tying material through the eye of a button comprises a needle, aligned aperatures extending perpendicular to said slot provided in the wall of said slot for the passage of said needle, and stop means provided in said slot for engagement by the eye or eye shank of a button, the stop means being so arranged that when the eye or eye shank of a button is in engagement therewith the eye of the button will be aligned with said aperatures.

9. Apparatus according to claim 7, wherein said button supporting means is adapted to support a button of the kind comprising a metal backing plate and a metal wire loop projecting from the backing plate and forming the eye of the button and wherein said button supporting means comprises magnetic means for maintaining a said button with its eye in engagement with said slot.

10. Apparatus according to claim 9, wherein said magnetic means comprises a magnetic block one surface of which forms one wall of said slot.

11. Apparatus according to claim 1, wherein said button supporting means and said looping means are respectively mounted on opposed limbs of a substantially U-shaped frame member.

* * * * *